US007419275B2

(12) United States Patent
Huang

(10) Patent No.: US 7,419,275 B2
(45) Date of Patent: Sep. 2, 2008

(54) MAGNETIC ILLUMINATION

(76) Inventor: Ming Huang, P.O. Box 166-13, Taipei (TW) 115

( * ) Notice: Subject to any disclaimer, the term of this patent is extended or adjusted under 35 U.S.C. 154(b) by 31 days.

(21) Appl. No.: 11/651,506

(22) Filed: Jan. 10, 2007

(65) Prior Publication Data

US 2008/0165524 A1 Jul. 10, 2008

(51) Int. Cl.
*F21V 33/00* (2006.01)

(52) U.S. Cl. ..... 362/118; 362/205; 362/394

(58) Field of Classification Search ..... 362/109, 362/118, 186, 190, 202, 205, 206, 253, 394
See application file for complete search history.

(56) References Cited

U.S. PATENT DOCUMENTS 4,542,261 A * 9/1985 Behnke ..... 178/19.01
4,677,428 A * 6/1987 Bartholow ..... 345/180
4,833,926 A * 5/1989 Todoroki et al. ..... 73/862.041
2004/0161288 A1* 8/2004 Tsai ..... 401/195

* cited by examiner

*Primary Examiner*—Thomas M Sember

(57) ABSTRACT

A printed circuit board (PCB) has a "U" shape circuit connected to a light emitting diode (LED) by a proximal end, connected to a conducting spring by a distal end. LED mounted inside a conducting shell to emit light toward a light guide tube by magnetic attraction realized by a conducting member having a conducting pole; a refill fits through the light guide tube, and a magnet mounted inside a cap member. One lead of the LED electrically connected to an anode of batteries, the other lead electrically connected to the conducting shell. But the batteries are insulated from the conducting shell; a cathode of the batteries electrically connected to the conducting pole, which is insulated from the conducting shell, as the magnet attracts to the conducting pole and conducting shell by magnetic attraction to conduct an electric current, the LED is lit up for illumination.

10 Claims, 8 Drawing Sheets

MAGNETIC ILLUMINATION

FIELD OF INVENTION

The present invention relates to a cap magnetically combined to a shaft to illuminate a light emitting diode (LED) inside the shaft.

BACKGROUND OF INVENTION

LED, hidden from view, mounted inside pen to illuminate for writing are already disclosed in international patent database.

Pressing a pushbutton, pushing a slide, rotating a shaft or a cap, or elevating a refill etc., may electrify LED inside pen to illuminate and a further press, push, or rotation of a switch darken it.

As above, equipped with an on-off switch to determine whether LED is lit simply manually operated by user. But, LED inside pen lit up spontaneously without manual operation without on-off switch is sought by the present invention.

SUMMARY OF INVENTION

Accordingly, the present invention is to provide a pen emitting light spontaneously without on-off switch.

Point against aforesaid problems, according to one embodiment of the present invention, a magnetic attraction illuminated pen comprising a luminary 5 includes a conducting shell 55, a plurality of batteries 54 mounted inside the conducting shell 55, and a light emitting diode (LED) 50; a light guide tube 4 disposed to a proximal end 55*a* of the conducting shell 55, a conducting member 6 with a conducting pole 60 disposed at a distal end 55*b* of the conducting shell 55, a conical metal hood 2 is disposed to a proximal end of the light guide tube 4, a refill 3 can move to and fro inside the conical metal hood 2 and the light-guide tube 4, a cap member 1 fit over the conducting shell 55 for writing characterized in that: the LED 50 inside the conducting shell 55 emits light toward the light guide tube 4, a first lead 502 of the LED 50 connected to an anode of the batteries 54, a second lead 501 connected to the conducting shell 55; a cathode of the batteries 54 connected to the conducting pole 60, an insulated film 56 wraps around an outer wall of the batteries 54, which is out of contact with the conducting shell 55; an insulation ring 61 disposed around the conducting pole 60, which is thereby insulated from the conducting shell 55; a magnet 19 mounted inside a cap 14 of the cap member 1 attracts distal ends 601, 551 of the conducting pole 60 and the conducting shell 55 with magnetic attraction to conduct electric current to light up the LED 50.

According to another aspect of the present invention, a magnetic attraction illuminated pen wherein a trough 191 is formed through a center of the magnet 19 inside the cap 14 for receiving a nib 31 of the refill 3.

According to another aspect of the present invention, a magnetic attraction illuminated pen wherein the light guide tube 4 is a transparent acrylic tube with laser engraved patterns.

According to another aspect of the present invention, a magnetic attraction illuminated pen further comprising a printed circuit board (PCB) 51 connected to the LED 50 by a proximal end, connected to a conducting spring 52 by a distal end, the first lead 502 of the LED 50 is soldered to a proximal end of the conducting spring 52, a distal end of the conducting spring 52 is electrically connected to the anode of the battery 54; the second lead 501 of the LED 50 is soldered to a conducting circuit 52, which is electrically connected to an inner wall of the conducting shell 55, but not connected to the conducting spring 52.

According to another embodiment of the present invention, a magnetic attraction illuminated pen comprising a luminary 5 includes a conducting shell 55, a plurality of batteries 54 mounted inside the conducting shell 55, and an LED 50; a light guide tube 4 disposed to a proximal end 55*a* of the conducting shell 55, a conducting member 6 with a conducting pole 60 disposed at a distal end 55*b* of the conducting shell 55, a conical metal hood 2 disposed to a proximal end of the light guide tube 4, a refill 3 can move to and fro inside the conical metal hood 2 and the light-guide tube 4, a cap member 1 fits over the conducting shell 55 for writing characterized in that: the LED 50 inside the conducting shell 55 emits light toward the light guide tube 4, a first lead 502 of the LED 50 electrically connected to an anode of the batteries 54, a second lead 501 electrically connected to the conducting shell 55; a cathode of the batteries 54 electrically connected to the conducting pole 60, an insulated film 56 wraps around an outer wall of the batteries 54, the insulated film 56 is out of contact with the conducting shell 55; an insulation ring 61 fits around the conducting pole 60, which is therefore insulated from a conducting ring 62 at the distal end 55*b* of the conducting shell 55; a magnet 19 mounted inside a cap 14 of the cap member 1 attracts distal ends 601, 551 of the conducting pole 60 and the conducting shell 55 with magnetic attraction to conduct electric current for illumination, the LED 50 is electrified to light up.

According to another aspect of the present invention, a magnetic attraction illuminated pen wherein the conducting pole 60 consists of a metal pole 60*a*, and an opening at a proximal end of a metal tub 60*b* for the metal pole 60*a* embedded therein, a distal end of the metal tub 60*b* electrically connected to the cathode of the batteries 54.

According to another aspect of the present invention, a magnetic attraction illuminated pen wherein the conducting ring 62 consists of a gasket 62*a*, and a threaded nut ring 62*b* having a central tube projected upward embedded in the gasket 62*a*, the threaded nut ring 62*b* having outer threads screwed to a threaded hole 552 formed on the distal end 55*b* of the conducting shell 55.

According to another aspect of the present invention, a magnetic attraction illuminated pen wherein a trough 191 is formed through a center of the magnet 19 inside the cap 14 for receiving a nib 31 of the refill 3.

According to another aspect of the present invention, a magnetic attraction illuminated pen further comprising a printed circuit board (PCB) 51 connected to an LED 50 by a proximal end, connected to a conducting spring 52 by a distal end, a proximal end of the conducting spring 52 connected to the first lead 502 of the LED 50, a distal end of the conducting spring 52 is electrically connected to the anode of the battery 54; the second lead 501 of the LED 50 soldered to a conducting circuit 52 of the PCB 51, the conducting circuit 52 is electrically connected to an inner wall of the conducting shell 55, but not connected to the conducting spring 52.

According to another aspect of the present invention, a magnetic attraction illuminated pen wherein the light guide tube 4 is a transparent acrylic tube with laser engraved patterns.

DETAILED DESCRIPTION OF THE PREFERRED EMBODIMENTS

The present invention has two embodiments, detailed description of the present invention is described according to the appended drawings hereinafter.

First Embodiment

Figure 1:
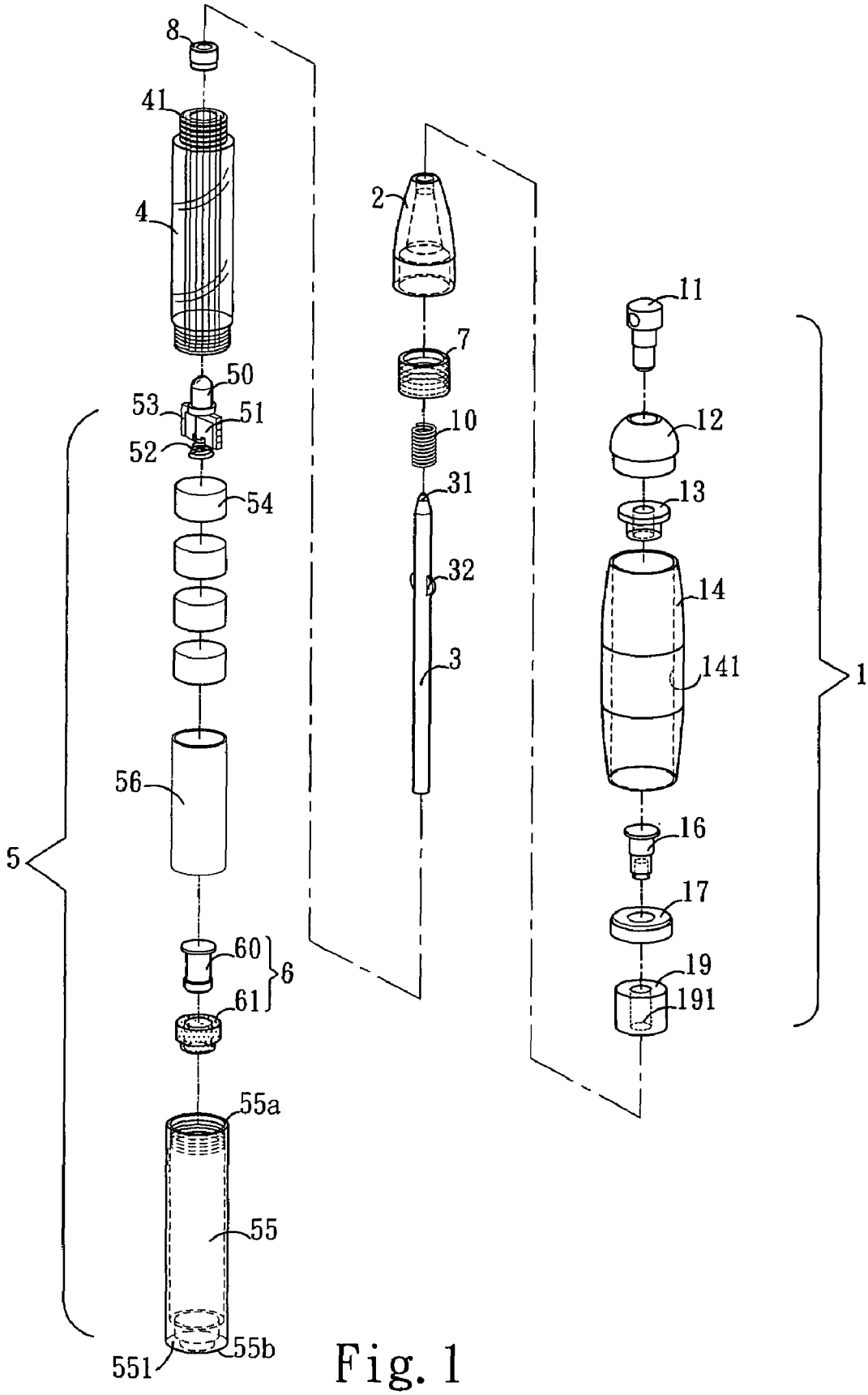
FIG. 1: shows an exploded view of the first embodiment of the magnetic attraction illuminated pen of the present invention.

Referring to FIG. 1, a magnetic attraction illuminated pen includes a luminary 5, a light guide tube 4, a refill 3, a conical metal hood 2, and a cap member 1.

The luminary 5 consists of a conducting shell 55, a light emitting diode (LED) 50 is mounted inside the conducting shell 55 and electrically connected thereto; a plurality of batteries 54 are also mounted inside the conducting shell 55, an anode of the batteries 54 is electrically connected to the conducting shell 55; an insulated film 56 wraps around a circumference of the batteries 54, which are therefore electrically insulated from the conducting shell 55.

The light guide tube 4 is disposed to a proximal end 55*a* of the conducting shell 55 of the luminary 5; further an LED 50 is disposed to the proximal end 55*a* thereof. The light guide tube 4 is made of acrylic transparent tube formed with light-guide laser-engraved patterns. The LED 50 emits light from a distal end of the light guide tube 4 through the laser-engraved patterns to a proximal end thereof, the LED 50 is a full color LED has different light outputs.

The conducting member 6 is disposed to a distal end 55*b* of the conducting shell 55 of the luminary 5. The conducting member 6 consists of a conducting pole 60 electrically connected to a cathode of the batteries 54, and an insulation ring 61 fits around a circumference of the conducting pole 60. The insulation ring 61 is inserted between the conducting pole 60 and the conducting shell 55 to insulate the conducting pole 60 from the conducting shell 55.

The conical metal hood 2 is disposed to a proximal end of the light guide tube 4, while the refill 3 can move to and fro inside the conical metal hood 2 and the light guide tube 4. The cap member 1 consists of a hollowed cap 14, and a magnet 19, hidden from view, mounted inside the cap 14 magnetically attracts both the conducting pole 60 and the conducting shell 55. Magnetic attraction of the magnet 19 will be discussed in detail hereinafter.

Figure 4A:
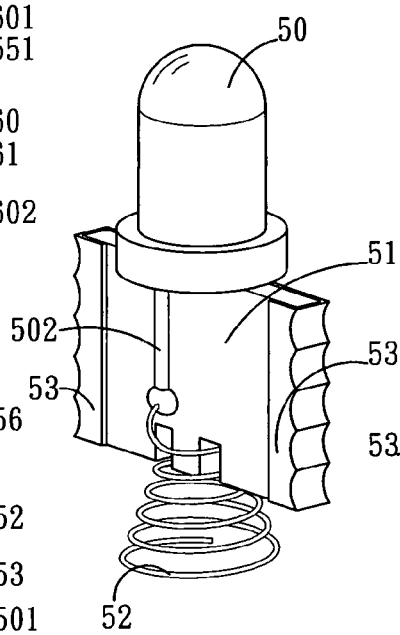
FIG. 4A: shows a diagrammatic view of a second surface of the light emitting diode (LED) constructed on a printed circuit board (PCB), where a first lead 502 connected to a conducting ring.
Figure 4B:
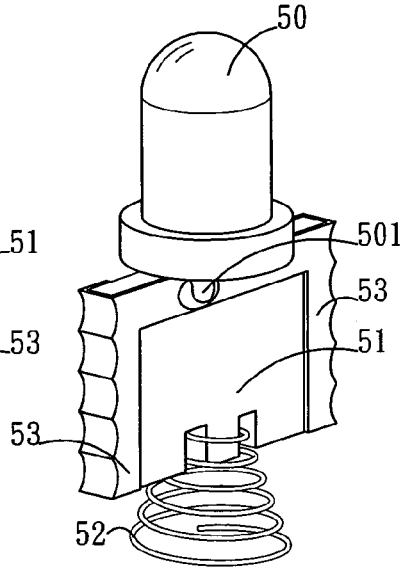
FIG. 4B: shows a diagrammatic view of a first surface of the LED constructed on the PCB, where a second lead 501 connected to "U" type conducting circuit.

Referring to FIGS. 4A, 4B, a first lead 502 of the LED 50 connected to the anode of the battery 54, a second lead 501 of the LED 50 connected to an inner wall of the conducting shell 55. As depicted in FIGS. 4A and 4B, a conducting circuit 53 of a printed circuit board (PCB) 51 is in contact with the second lead 501 of the LED 50 fixed to a proximal end of the PCB 50 and both leads 501, 502 of the LED 50 soldered to a first surface and a second surface of the PCB 51 respectively. On one hand, on the first surface of the PCB, the second lead 501 extended to the conducting circuit 53 shaped as a half-circled "U" type circuit (or just cladding with metal foil can conduct electricity) soldered along a boarder of the PCB 51. On the other hand, on the second surface of the PCB, a proximal end of a conducting spring 52 soldered together with the first lead 502 by soldering, whereby the conducting spring 52 is fixed to a distal end of the PCB 51. Moreover, on the second surface of the PCB 51, only two lateral sides clad with metal foil extended from the U type circuit on the first surface, but these circuits or metal foils of the conducting circuit 53 are kept a distance to the conducting spring 52 and the soldered first lead 502 of the LED 50 to keep an electric insulation between them. As a result, a proximal end of the conducting spring 52 is connected to the lead 502 of the LED 50, while a distal end of the conducting spring 52 is electrically connected to the anode of the batteries 54 so that the first lead 502 is electrically connected to the anode of the batteries 54. The conducting circuit 53 is not connected to the conducting spring 52, but the conducting circuit 53 is connected to an inner wall of the conducting shell 55. The conducting circuit 53 is configured along one U type half-circle along a circumference of the first surface of the PCB 51 and the other both lateral sides of the second surface of the PCB 51. Thereby, both two surfaces and lateral sides of the PCB 51 facilitates a better-conducting contact with the inner wall of the conducting shell 55. And both lateral sides of the PCB are formed as a series of teeth to contact to the inner wall of the conducting shell 55 with a better-conducting capacity.

PCB 51 is integrated with an integral circuit, where the conducting circuit 53 defined as a surface layer between the PCB and the LED to activate and electrify the LED 50 for illumination in the process of intermittent emission of light, or programmed light emission, or timely shining. One lead 501 of the LED 50 is electrically connected to the anode of the battery 54 by way of the conducting spring 52, and the other lead 502 of the LED 50 is in better-conducting contact with the conducting shell 55. PCB 51 is also constructed as a base to affix the LED 50 thereon, LED is stably fixed inside the conducting shell 55 without any movements.

Figure 2:
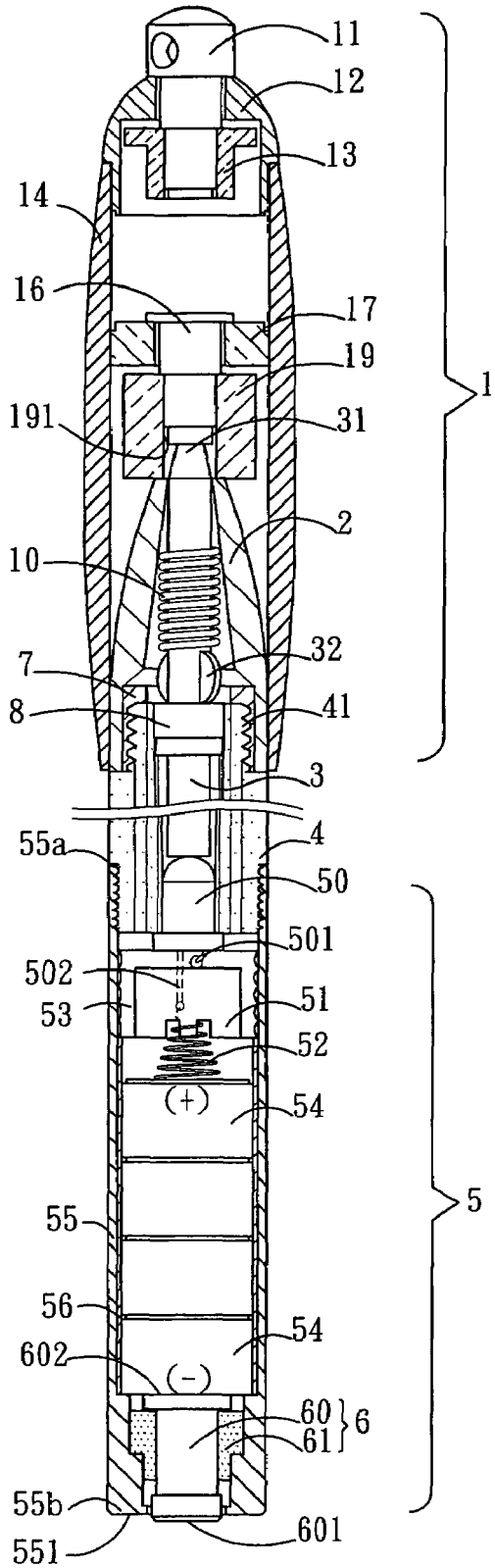
FIG. 2: shows a cross sectional view of the magnetic attraction illuminated pen of FIG. 1.

Referring to FIG. 2, a magnet 19 inside the cap 14 is formed with a trough 191 for receiving a nib 31 of the refill 3; the trough 191 is formed through a center of the magnet 19. As the magnet 19 inside the cap 14 is drawn near the metal hood 2 to attract the metal hood 2 with magnetic attraction where metal ions oriented in same direction. The nib 31 led into the trough 191 in position, further the nib 31 is positioned properly within the magnet 19 caused by magnetic attraction through the trough 191 at the center of the magnet 19. Thereby, the nib 31 is fully protected within the magnet 19 inside the cap 14, unless an outer force exerted to the magnet 19 and the nib 31 is greater than the magnetic attraction, the metal hood 2 may be separated from the cap member 1. Otherwise, the nib is positioned precisely inside the trough 191 of the magnet 19 inside the cap 14.

The trough 191 of the magnet 19 accommodates a fixed pole 16 of a positioning ring 17 fixed therein. The positioning ring 17 fit in an inner wall 141 of the cap 14 without falling off. Further, an opening at a proximal end of the cap 14 is suitable for a lid 12 embedded therein. Furthermore, a hitch pole 11 with a lower portion passed through the lid 12 fits through a lock cylinder 13, a horizontal hole at a topmost portion of the hitch pole 11 accommodates a chain ring attached with a cord transversally passed through to hang the pen. Also a clip on the cap 15 can be used to clinch to a user's pocket.

A nut 7 is embedded in the metal hood 2 for screwing to a threaded end 41 at the proximal end of the light guide tube 4. A stopper ring 8 is embedded in the threaded end 41 to resist a pair of flaps 32, which can be shaped by extruding part of the refill made of metal, protruded out from both sides of the refill 3; an expanded spring fits over the refill 3 in front of the pair of flaps 32.

Figure 3:
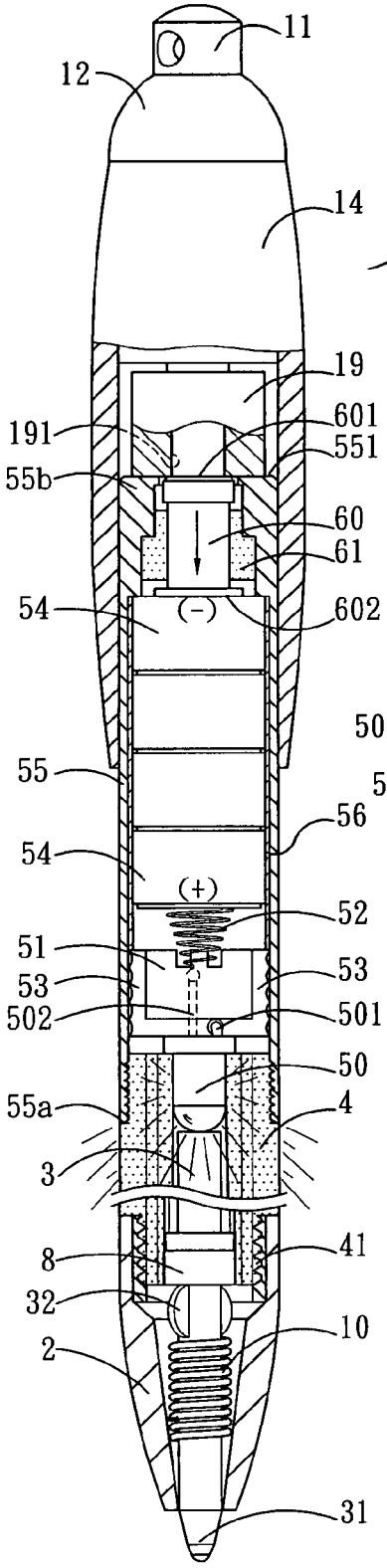
FIG. 3: shows a cross sectional view of the magnetic attraction illuminated pen of FIG. 1 when illuminating.

Referring to FIG. 3, when illuminating, a distal end of the luminary 5 is inserted into the cap 14 of the cap member 1, the magnet 19 inside the cap 14 generates magnetic attraction to a distal end 551 of the conducting shell 55 as well as a distal end 601 of the conducting pole 60. Consequently, negative current of the battery 54 flows from the cathode through the conducting pole 60 and the magnet 19 first to the conducting shell 55 and then to the PCB 51 finally to the LED 50, where the LED 50 is already connected to the anode of the batteries by the conducting spring fed with positive current, thereby, the LED is electrified by the positive and negative electric currents for illumination. Conversely, magnetic attraction is weaker than an outer force the magnet 19 is detached from the distal ends 551, 601 of the conducting shell 55 and the conducting pole 60. The LED 50 is dimmed.

After the cap member 1 fits over the luminary 5 for illumination, the LED 50 can emit light spontaneously. Conversely, when the cap member 1 is detached from the luminary 5, there is no emission of light from the LED 50. Magnetic attraction illuminated pen is, therefore, more prompt and prominent than a conventional illuminated pen with on-off switch.

Second Embodiment

Figure 5:
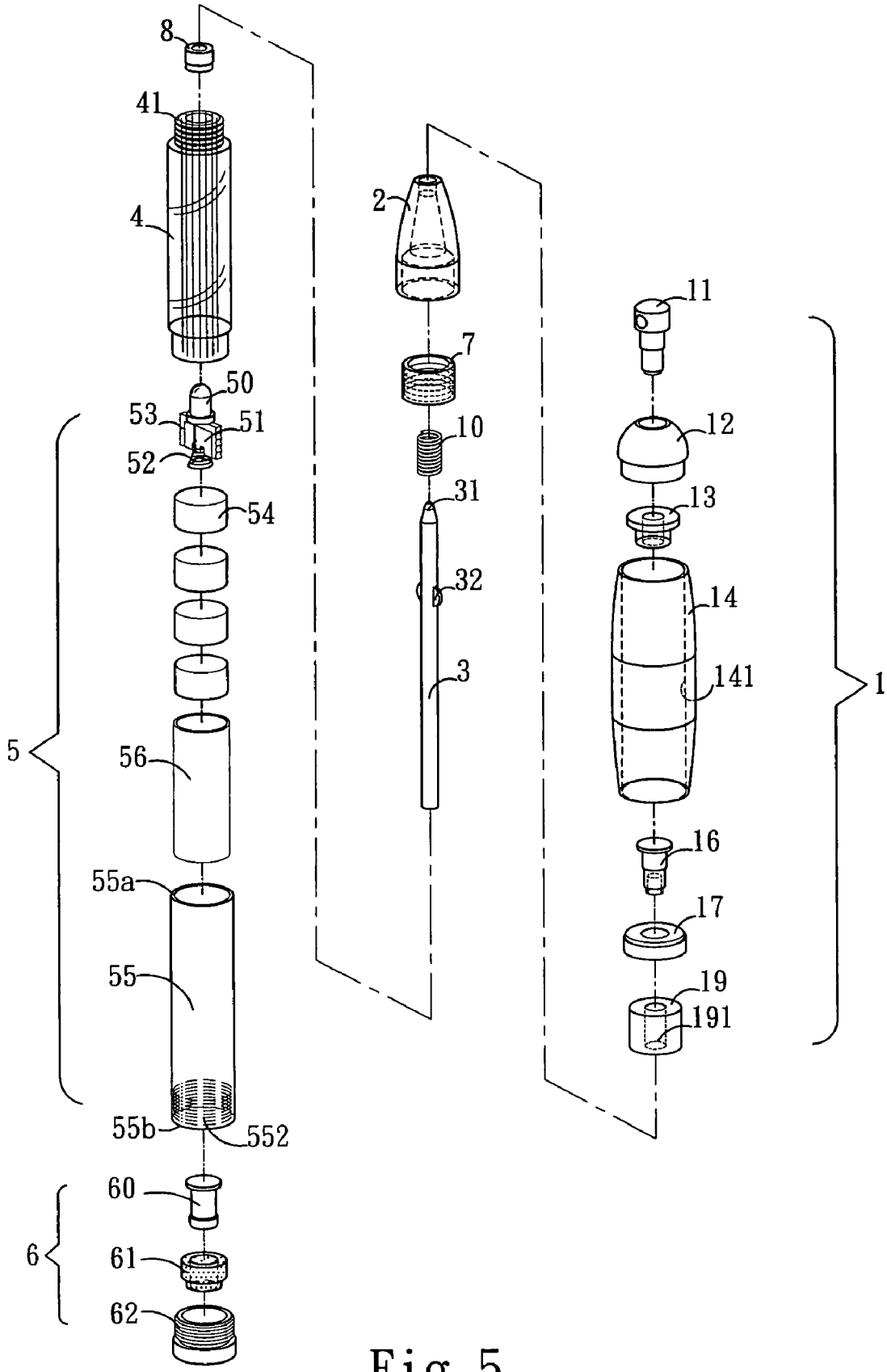
FIG. 5: shows an exploded view of the second embodiment of the magnetic attraction illuminated pen of the present invention.
Figure 6:
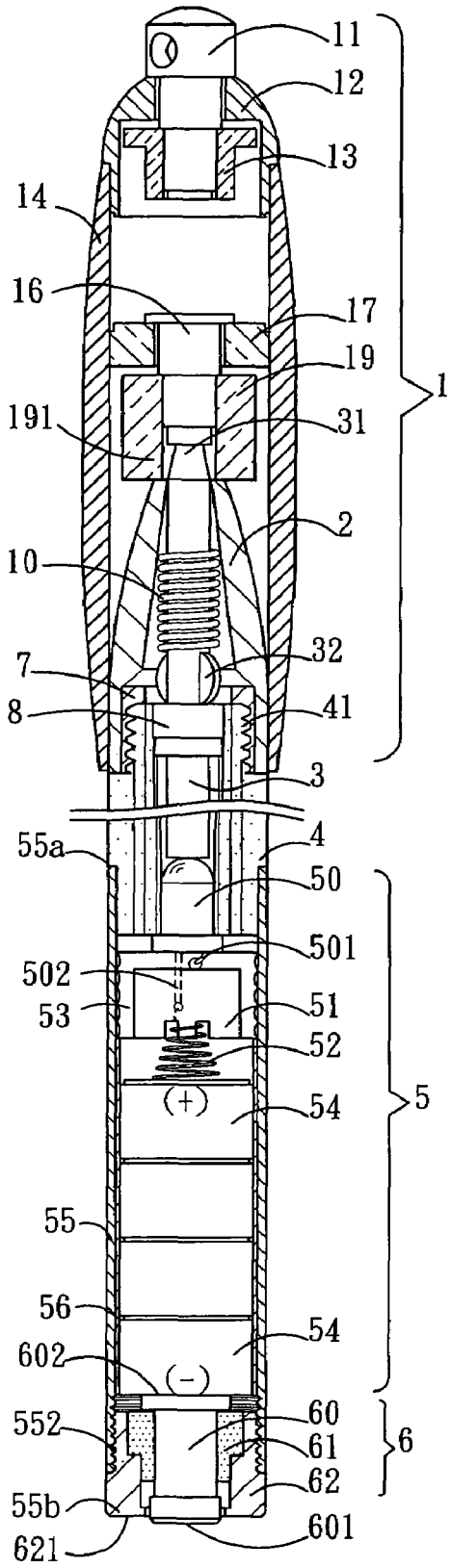
FIG. 6: shows a cross sectional view of FIG. 5.
Figure 7:
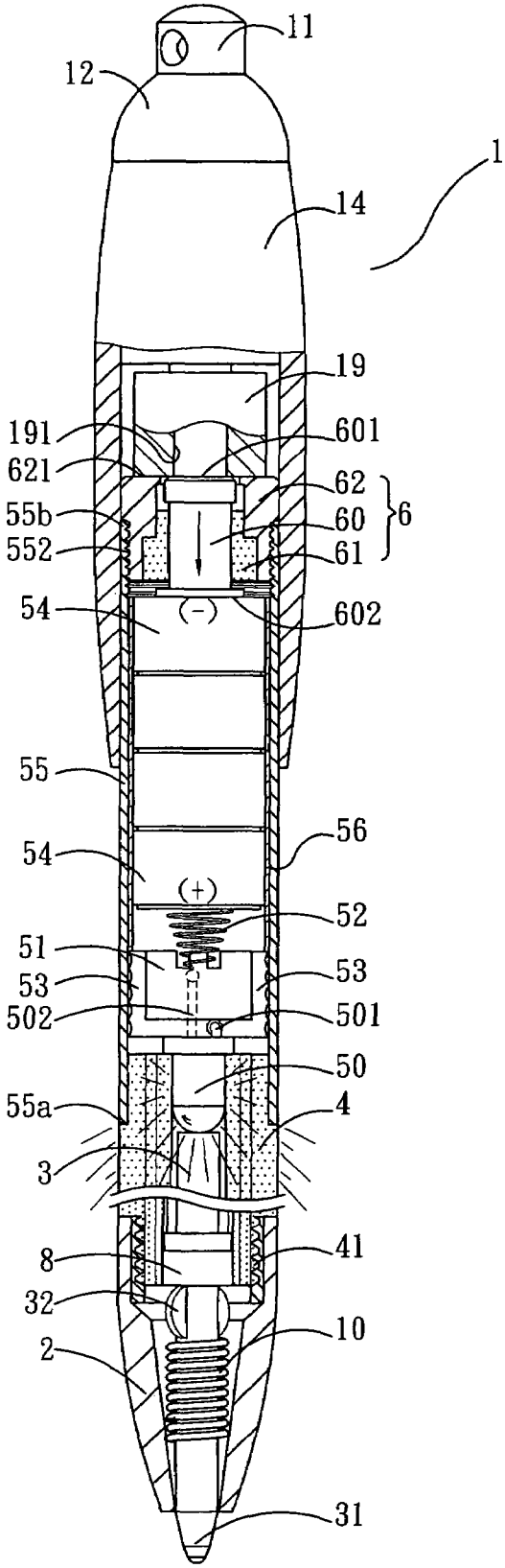
FIG. 7: shows a cross sectional view of FIG. 5 when illuminating.

Referring to FIGS. 5~7, a conducting member 6 includes a conducting pole 60, a conducting ring 62 disposed around a circumference of the conducting pole 60, an insulation ring 61 fit over the conducting pole 60 and introduced between the conducting pole 60 and the conducting ring 62 to insulate them from electrically conduction with each other. The conducting ring 62 is screwed to a threaded hole 552 at the distal end 55*b* of the conducting shell 55, it facilitates the batteries 54 easy for installation or taking out. A distal end 621 of the conducting ring 62 is broader than the distal end 551 of the conducting shell 55, thereby, the conducting ring 62 secured to the conducting shell 55 further facilitates magnetic attraction for better-conducting electric current by the magnet 19.

Figure 8:
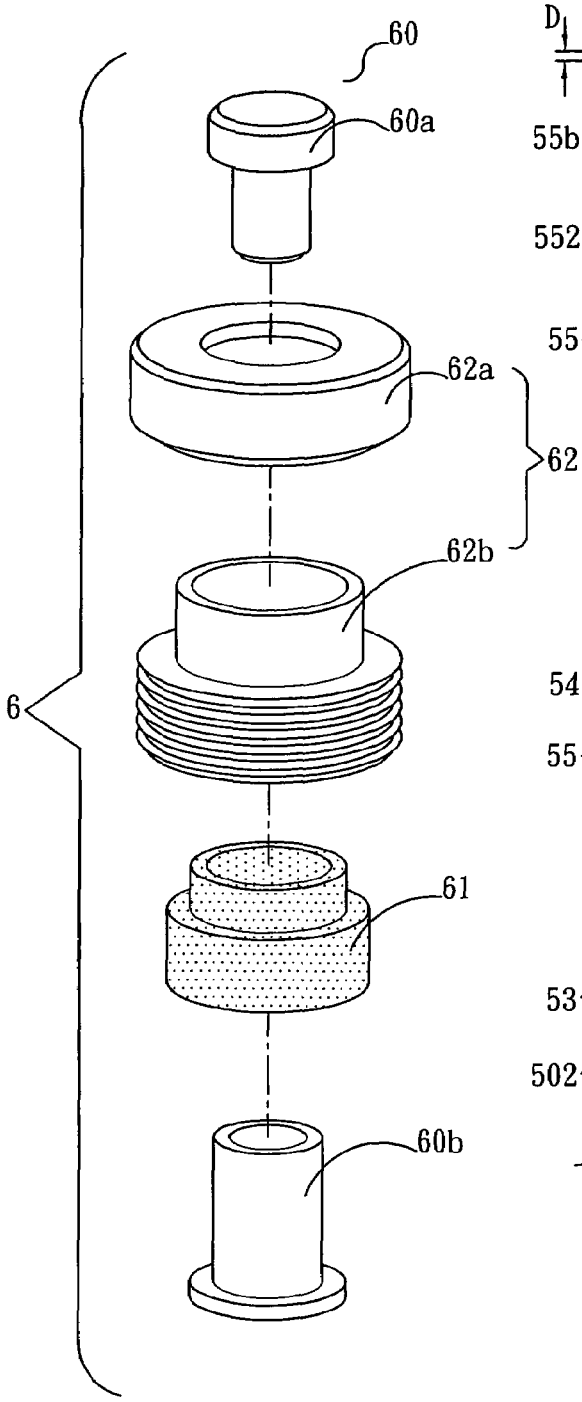
FIG. 8: shows an exploded view of another embodiment of the conducting member of the present invention.
Figure 9:
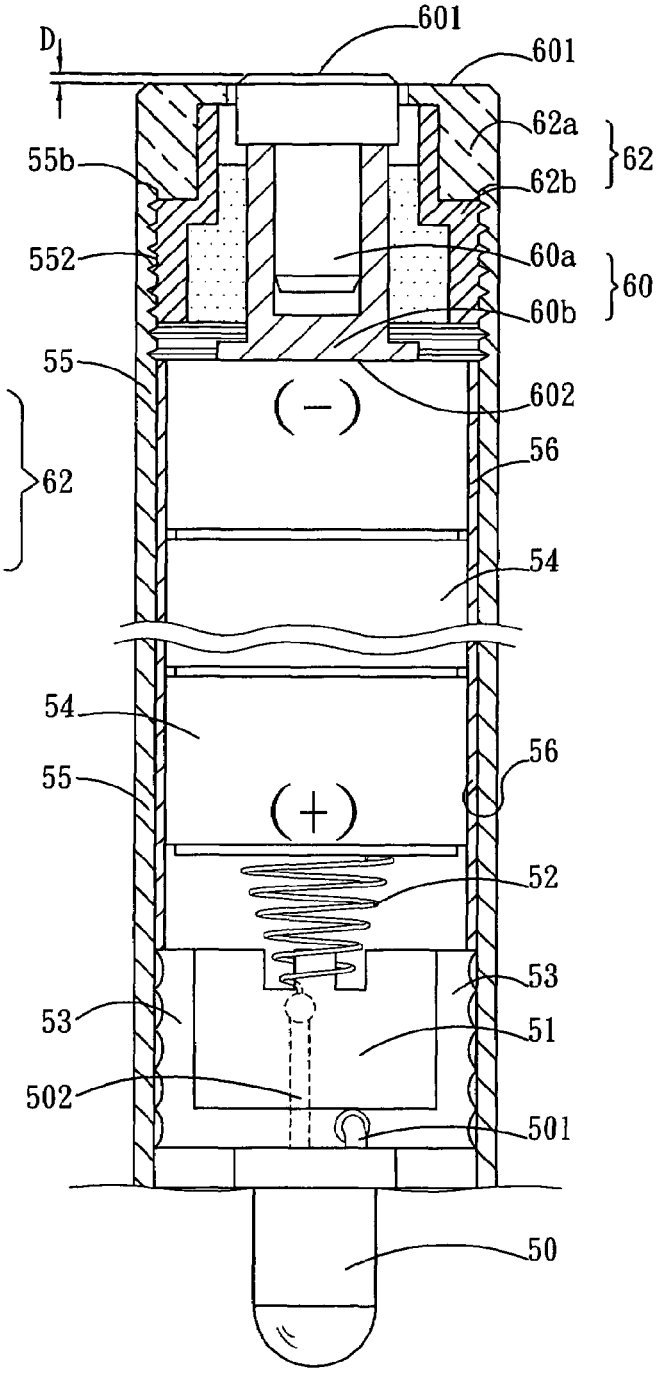
FIG. 9: shows an assembled view of the conducting member of FIG. 8.

Referring to FIGS. 8~9, a conducting pole 60 consists of a metal pole 60*a*, and a metal tub 60*b* having an opening at a proximal end where the conducting pole 60*a* embedded therein, a distal end of the metal tub 60*b* is electrically connected to a cathode of the battery 54. The conducting ring 62 consists of a gasket 62*a*, and a nut ring 62*b* with a central tube projected upward embedded in the gasket 62*a*, the nut ring 62*b* further having outer threads formed on a circumference screwed to a threaded hole 552 of the distal end of the conducting shell 55.

Figure 10A:
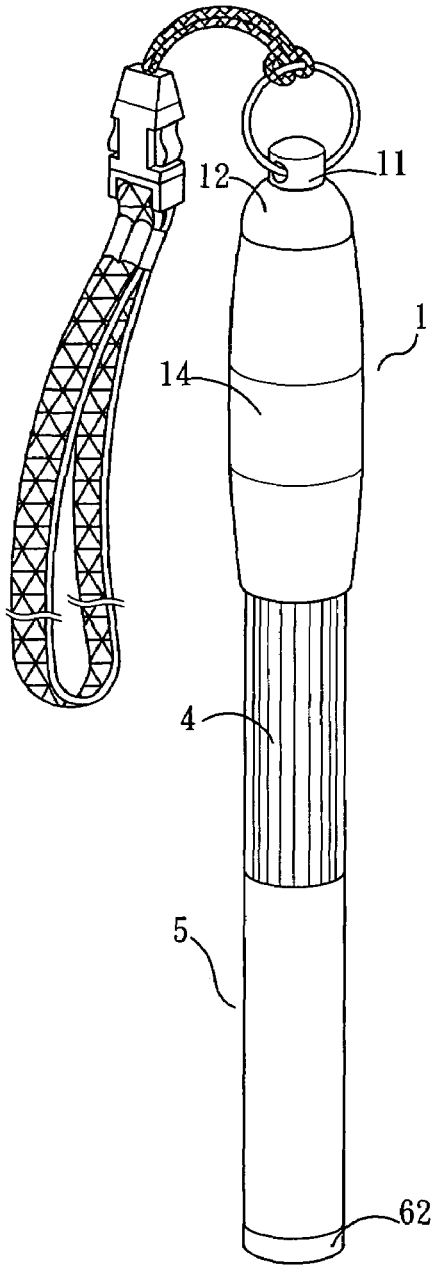
FIGS. 10A-10C: show diagrammatic views of the present invention in application.

Referring to FIG. 10A, the cap 14 of the cap member 1 fits over the metal hood 2 of the proximal end of the light guide tube 4, thereby, the metal hood 2 is magnetically attracted to the cap member 1 with a chain ring attached with a cord passed through a horizontal hole can be brought with users in person.

Figure 10B:
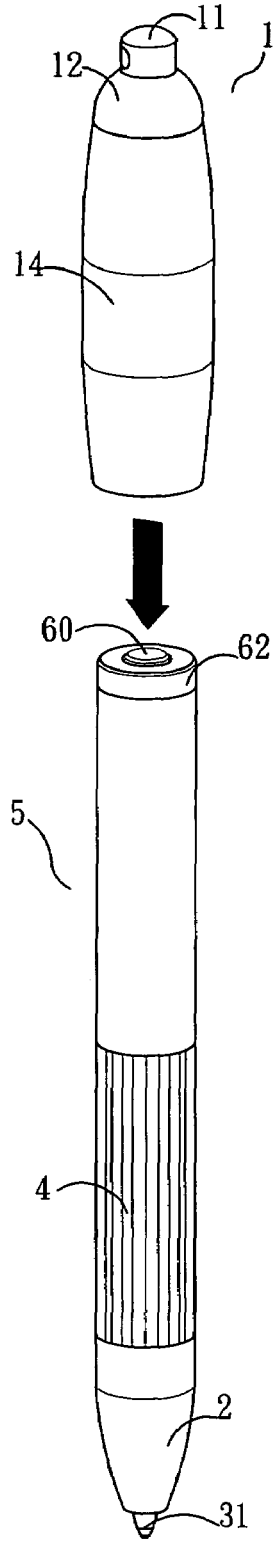

Referring to FIG. 10B, after a shaft makes reverse rotation; the LED 50 is still dimmed before the cap 14 fits over the lit-up member 5.

Figure 10C:
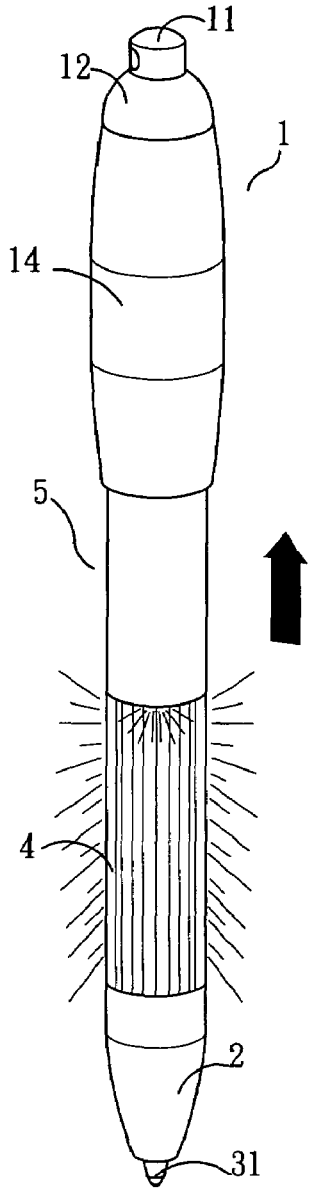

Referring to FIG. 10C, once the cap 14 fits over the luminary 1, the magnet 19 inside the cap 14 is attracted to the conducting member 6 to generate magnetic attraction for illumination as the LED 50 is electrified to light. To illuminate a pen based on whether the magnet 19 is to attract the conducting member 6 by magnetic attraction or not.

According to the appended drawings, the anode of the battery 54 is electrically connected to the lead 502 of the LED 50 by the conducting spring 52. While the cathode of the battery 54 is electrically connected to the conducting pole 60. However, the anode and cathode of the battery 54 is not limited to the locations as depicted in the appended drawings, but the cathode can be electrically connected to the lead 502 of the LED 50, the anode can be electrically connected to the conducting pole 60.

The benefits and advantages can be achieved by the present invention as following:

Only the cap member 1 fits over the luminary 5, the LED 50 is to emit light spontaneously. Conversely, when the cap member 1 is detached from the luminary 5, light emission of the LED 50 is dimmed. In application, magnetic attraction facilitates lighting up an illuminated pen is easy to operate.

When the cap member 1 fits over the metal hood 2, the magnet 19 mounted inside the cap 14 generates magnetic attraction to the metal hood 2, the nib 31 of the refill 3 is also protected by a trough formed through a center of the magnet.

The magnet 19, hidden from view, mounted inside the cap 14 is not only protected by the cap 14 but also insulated from magnetic attraction to metal objects outside the cap 14.

Emission of light from full color LED 50 shows changes in color as desired, the light guide tube 4 emits light from a distal end through laser-engraved patterns to the proximal end, whereby light emission of the light guide tube 4 is prominent and prompt.

The invention claimed is:

1. A magnetic attraction illuminated pen comprising a luminary (5) includes a conducting shell (55), a plurality of batteries (54) mounted inside the conducting shell (55), and a light emitting diode (LED) (50); a light guide tube (4) disposed to a proximal end (55*a*) of the conducting shell (55), a conducting member (6) with a conducting pole (60) disposed to a distal end (55*b*) of the conducting shell (55), a conical metal hood (2) is disposed to a proximal end of the light guide tube (4), a refill (3) can move to and fro inside the conical metal hood (2) and the light-guide tube (4), a cap member (1) fits over the conducting shell 55 for writing characterized in that: the LED (50) inside the conducting shell (55) emits light toward the light guide tube (4), a first lead (502) of the LED (50) connected to an anode of the battery (54), a second lead (501) connected to the conducting shell (55); a cathode of the battery (54) connected to the conducting pole (60), an insulated film (56) wraps around an outer wall of the battery (54), which is therefore out of contact with the conducting shell (55); an insulation ring (61) disposed around the conducting pole (60), which is thereby insulated from the conducting shell (55); a magnet (19) mounted inside a cap (14) of the cap member (1) attracts distal ends (601), (551) of the conducting pole (60) and the conducting shell (55) with magnetic attraction to conduct electric current to light up the LED (50).

2. A magnetic attraction illuminated pen as claim 1 claimed wherein a trough is formed through a center of the magnet (19) inside the cap (14) for receiving a nib (31) of the refill (3).

3. A magnetic attraction illuminated pen as claim 1 claimed wherein the light guide tube (4) is a transparent acrylic tube with laser engraved patterns.

4. A magnetic attraction illuminated pen as claim 1 claimed further comprising a printed circuit board (PCB) (51) connected to the LED (50) by a proximal end, connected to a conducting spring (52) by a distal end, the first lead (502) of the LED (50) is soldered to a proximal end of the conducting spring (52), a distal end of the conducting spring (52) is electrically connected to the anode of the battery (54); the second lead (501) of the LED (50) is soldered to a conducting circuit (53), which is electrically connected to an inner wall of the conducting shell (55), but not connected to the conducting spring (52).

5. A magnetic attraction illuminated pen comprising a luminary (5) includes a conducting shell (55), a plurality of batteries (54) and an LED (50) mounted inside the conducting shell (55); a light-guide tube (4) disposed to a proximal end (55*a*) of the conducting shell (55), a conducting member (6) with a conducting pole (60) disposed at a distal end (55*b*) of the conducting shell (55), a conical metal hood (2) is disposed to a proximal end of the light-guide tube (4), a refill (3) can move to and fro inside the conical metal hood (2) and the light-guide tube (4), a cap member (1) fits over the conducting shell (55) for writing characterized in that: the LED (50) inside the conducting shell (55) emits light toward the light guide tube (4), a first lead (502) of the LED (50) electrically connected to an anode of the battery (54), a second lead (501) electrically connected to the conducting shell (55); a cathode of the battery (54) electrically connected to the conducting pole (60), an insulated film (56) wraps around an outer wall of the batteries (54), the insulated film (56) is out of contact with the conducting shell (55); an insulation ring (61) fits around the conducting pole 60, which is therefore insulated from a conducting ring (62) at the distal end (55*b*) of the conducting shell (55); a magnet (19) mounted inside a cap (14) of the cap member (1) attracts the distal ends (601), (551) of the conducting pole (60) and the conducting shell (55) with magnetic attraction conducts electric current for illumination, the LED (50) is electrified to light up.

6. A magnetic attraction illuminated pen as claim 5 claimed wherein the conducting pole (60) consists of a metal pole (60*a*), and an opening formed at a proximal end of a metal tub (60*b*) for the metal pole (60*a*) embedded therein, a distal end of the metal tub (60*b*) electrically connected to the cathode of the battery (54).

7. A magnetic attraction illuminated pen as claim 5 claimed wherein the conducting ring (62) consists of a gasket (62*a*), and a threaded nut ring (62*b*) having a central tube projected upward embedded in the gasket (62*a*), the threaded nut ring (62*b*) having outer threads along a circumference is screwed to a threaded hole (552) formed on the distal end (55*b*) of the conducting shell (55).

8. A magnetic attraction illuminated pen as claim 5 claimed wherein a trough (191) is formed through a center of the magnet (19) inside the cap (14) for receiving a nib (31) of the refill (3).

9. A magnetic attraction illuminated pen as claim 5 claimed further comprising a PCB (51) connected to an LED (50) by a proximal end, connected to a conducting spring (52) by a distal end, a proximal end of the conducting spring (52) connected to the first lead (502) of the LED (50), a distal end of the conducting spring (52) is electrically connected to the anode of the battery (54); the PCB (51) having a conducting circuit (53) connected to the second lead (501) of the LED (50), the conducting circuit (53) is electrically connected to an inner wall of the conducting shell (55), but not connected to the conducting spring (52).

10. A magnetic attraction illuminated pen as claim 5 claimed wherein the light guide tube (4) is a transparent acrylic tube with laser engraved patterns.

* * * * *